US005568084A

United States Patent [19]

McClure et al.

[11] Patent Number: 5,568,084

[45] Date of Patent: Oct. 22, 1996

[54] CIRCUIT FOR PROVIDING A COMPENSATED BIAS VOLTAGE

[75] Inventors: David C. McClure, Denton; Thomas A. Teel, Carrollton, both of Tex.

[73] Assignee: SGS-Thomson Microelectronics, Inc., Carrollton, Tex.

[21] Appl. No.: 357,664

[22] Filed: Dec. 16, 1994

[51] Int. Cl.[6] ..... G05F 1/10

[52] U.S. Cl. ..... 327/538; 327/108; 327/543

[58] Field of Search ..... 323/312, 315; 327/108, 165, 166, 184, 261, 308, 374, 376, 377, 380, 381, 530, 538, 543; 331/57

[56] References Cited

U.S. PATENT DOCUMENTS

| | | | |
|---|---|---|---|
| 3,714,543 | 1/1973 | Sahara et al. | 323/315 |
| 4,325,019 | 4/1982 | Tezuka | 323/315 |
| 4,864,162 | 9/1989 | Maoz | 327/308 |
| 4,877,978 | 10/1989 | Platt | 307/473 |
| 4,999,567 | 3/1991 | Morigami | 323/315 |
| 5,276,356 | 1/1994 | Shirotori | 327/108 |
| 5,291,071 | 3/1994 | Allen et al. | 327/108 |
| 5,396,110 | 3/1995 | Houston | 327/172 |

*Primary Examiner*—Timothy P. Callahan
*Assistant Examiner*—Jeffrey Zweizig
*Attorney, Agent, or Firm*—Rodney M. Anderson; Theodore E. Galanthay; Renee M. Larson

[57] ABSTRACT

A bias circuit for generating a bias voltage over variations in the power supply voltage and over process parameters is disclosed. The bias circuit utilizes a voltage divider to generate a divided voltage based on the power supply value. The divided voltage is applied to the gate of a modulating transistor (biased in saturation) in a current mirror, which controls a current applied to a linear load device biased in the linear region. The voltage across the load device determines the bias voltage. Variations in the power supply voltage are thus reflected in the bias voltage, such that the gate-to-source voltage of the series transistor is constant over variations in power supply voltage. Variations in process parameters that produce different transistor current drive characteristics are reflected in a variations of the bias voltage produced by the linear load device. The bias circuit may control the slew rate of an output driver, may control the propagation delay through a delay element, and be used to control the duration of a pulse produced by a pulse generating circuit.

4 Claims, 3 Drawing Sheets

CIRCUIT FOR PROVIDING A COMPENSATED BIAS VOLTAGE

This invention is in the field of integrated circuits, and is more particularly directed to the generation of a bias voltage that is compensated for power supply and manufacturing process variations.

BACKGROUND OF THE INVENTION

As is fundamental in the art, the high performance available from modern integrated circuits derives from the transistor matching that automatically results from the fabrication of all of the circuit transistors on the same integrated circuit chip. This matching results from all of the devices on the same chip being fabricated at the same time with the same process parameters. As such, the circuits operate in a matched manner over wide variations in power supply voltage, process parameters (threshold voltage, channel length, etc.), and temperature.

However, mere matched operation of the devices on the integrated circuit does not guarantee proper operation, but only means that all devices operate in a matched fashion relative to one another. If, for example, the integrated circuit is manufactured at its "high-current corner" conditions (minimum channel lengths, minimum threshold voltages), all transistors in the chip will have relatively high gains, and will switch relatively quickly; the integrated circuit will thus operate at its fastest, especially at low temperature with maximum power supply voltage applied. Conversely, if the integrated circuit is manufactured at its "low-current corner" (maximum channel lengths, maximum threshold voltages), all transistors in the chip will have relatively low gains and slow switching speeds, and the integrated circuit will operate at its slowest rate, especially at high temperature and the minimum power supply voltage. Accordingly, the factors of processing variations, power supply voltage, and temperature greatly influence the speed and overall functionality of the integrated circuit.

The circuit designer must take these variations into account when designing the integrated circuit. For example, the circuit designer may wish to have a certain internal clock pulse to occur very quickly in the critical data path of an integrated memory circuit. However, the above-noted variations in process, voltage and temperature limit the designer's ability to set the fastest timing of the clock pulse at the slowest conditions (low-current process corner, low voltage, high temperature) without considering that the circuit may be so fast at its fastest conditions (high-current process corner, high voltage, low temperature) that the clock may occur too early or the clock pulse may be too narrow. An example of such an internal clock pulse is the clock pulse for the sense amplifier in an integrated circuit memory for which delay directly affect access time; if the sense amp clock occurs too early, however, incorrect data may be sensed.

As is well known in the art, a typical method for controlling the switching time of a circuit is to insert one or more series transistors in the switching path, and control the current through the series transistor with a bias voltage. Control of the bias voltage, in a manner that is compensated for the desired parameter, can thus control the switching of the circuit in a compensated manner.

Referring now to FIG. 1, the use of a series transistor to control the switching of an output stages of a conventional integrated circuit, such as microprocessors, memories and the like, will now be described.

The circuitry of FIG. 1 presents digital logic states on output terminals $OUT_i$, $OUT_j$ responsive to digital signals produced on lines $DATA_i$, $DATA_j$ by functional circuitry, not shown, that is resident on the same integrated circuit chip. Output terminals $OUT_i$, $OUT_j$ as illustrated in FIG. 1 are suggestive of bond pads at the surface of an integrated circuit chip, and as such are directly connected by way of wire bonds, beam leads, and the like to external terminals of a packaged integrated circuit. As such, certain other circuitry, such as electrostatic discharge protection devices and the like, while not shown, will typically be implemented along with the circuitry of FIG. 1. In addition, while the circuitry of FIG. 1 is illustrated for driving dedicated output terminals $OUT_i$, $OUT_j$, the output drive circuitry may drive common input/output terminals that not only present data but also receive data from external to the integrated circuit.

In the example of FIG. 1, output driver $\mathbf{2}_i$ drives output terminal $OUT_i$ with a logic state corresponding to the logic state present on line $DATA_i$, while output driver $\mathbf{2}_j$ drives output terminal $OUT_j$ with a logic state corresponding to the logic state present on line $DATA_j$. It is of course contemplated that more than two output drivers 2 are likely to be present on the integrated circuit chip; for example, modern microprocessor and memory devices may have up to as many as sixteen or thirty-two output terminals, and thus as many as sixteen or thirty-two output drivers 2. Output drivers $\mathbf{2}_i$, $\mathbf{2}_j$ are similarly constructed, and as such the following description of output driver $\mathbf{2}_i$ is contemplated to also describe the construction and operation of other output drivers 2 on the same integrated circuit.

Output driver $\mathbf{2}_i$ is of the CMOS push-pull type, and as such includes p-channel pull-up transistor 4 and n-channel pull-down transistor 8. The drains of transistors 4 and 8 are connected together to output terminal $OUT_i$, with the source of transistor 4 biased to $V_{cc}$ and the source of transistor 8 biased to ground. Input data line $DATA_i$ is connected, via inverting buffer 6, to the gate of p-channel pull-up transistor 4. Input data line $DATA_i$ is coupled to the gate of n-channel pull-down transistor 8 by way of an inverting logic function made up of transistors 10, 12, 14, such logic function also serving to control the switching, or slew, rate of output driver $\mathbf{2}_i$ as will become evident from the description hereinbelow.

The gate of n-channel pull-down transistor 8 is driven from the drains of p-channel transistor 12 and n-channel transistor 14, the gates of which are connected to input data line $DATA_i$. As such, transistors 12, 14 implement a logical inversion of the logic state of input data line $DATA_i$. The source of transistor 14 is biased to ground, while the source of transistor 12 is connected to the drain of p-channel bias transistor 10, which has its source biased to $V_{cc}$. The gate of p-channel bias transistor 10 is driven by a bias signal (on line BIAS) generated by bias circuit 5. In this arrangement, the current conducted by transistor 10 controls the drive current of transistor 12 when input data line $DATA_i$ is low (i.e., when transistor 8 is to be turned on), and thus the rate at which the gate of transistor 8 is pulled high responsive to a transition of input data line $DATA_i$ from high-to-low. The current of transistor 10 thus controls the rate at which pull-down transistor 8 is turned on when output terminal $OUT_i$ is to be switched from a high logic level to a low logic level.

As is well known in the art, inductive noise is generated as a result of the time rate of change of current applied to a load (dV=L di/dt). Higher switching speed thus generally results in increased noise, since the time rate of change of the current increases. Circuit designers generally select an operating point at an optimized condition, relative to switching speed and noise. In order to maintain this optimized operation, bias circuit 5 presents a bias voltage on line BIAS that is compensated for variations in power supply voltage, temperature, and process variations.

In the CMOS arrangement of FIG. 1, n-channel pull-down transistor 8 switches at a much faster rate than does p-channel pull-up transistor 4; this is due to the typically higher channel mobility for n-channel transistors than for p-channel transistors, as is well known in the art. As such, in the example of FIG. 1, slew rate control is only used to control the rate at which n-channel pull-down transistor 8 is turned on, and not the rate at which p-channel pull-up transistor 4 is turned on.

Prior techniques for generating the bias voltage on line BIAS via bias circuit 5 have been limited, however. One common technique is to use a bias circuit 5 that attempts to compensate for temperature variations. As is known in the art, the threshold voltage of a MOS transistor varies inversely with temperature. Accordingly, prior techniques have compensated for variations in temperature by relying on threshold voltage variations to produce a compensating bias voltage. For example, in the circuit of FIG. 1, bias circuit 5 may adjust the voltage on line BIAS to follow variations of a p-channel transistor threshold voltage, so that the quantity $|V_{gs}-V_{tp}|$ for transistor 10 would remain constant over temperature.

It has been found, however, that use of threshold voltage based bias circuits are not well-suited to compensate for both temperature variations and process parameter variations, however, since the threshold voltage is itself a process parameter. Variations in the process parameters may thus affect the ability of the circuit to compensate for temperature. Indeed, it has been observed that conventional bias voltage generating circuits that are compensated for temperature are not well compensated for variations in power supply voltage and process variations.

It is therefore an object of the present invention to provide a bias circuit for producing a compensated bias voltage that follows variations in power supply voltage and process parameters.

It is a further object of the present invention to provide such a bias circuit that robustly compensates for variations in power supply voltage and process parameters, such that temperature variations need not be considered.

Other objects and advantages of the present invention will be apparent to those of ordinary skill in the art having reference to the following specification together with its drawings.

SUMMARY OF THE INVENTION

The present invention may be implemented into a bias circuit for producing a voltage that tracks variations in process parameters and power supply voltage. The bias voltage is based on a resistor voltage divider that sets the current in the input leg of a current mirror; the output leg of the current mirror generates the bias voltage applied to the logic gate. The bias circuit is based on a modulating transistor that is maintained in saturation, which in turn dictates the current across a linear load device. As a result, the bias voltage will be modulated as a function of transistor drive current (which is based on the power supply voltage), such that the bias voltage tracks increases in the power supply voltage (and thus increases in drive current). Further, variations in the current through the current mirror, for example as result from process parameter variations, are reflected in the voltage across the linear load device. Robust compensation for variations in power supply voltage and process parameters is thus produced.

DETAILED DESCRIPTION OF THE PREFERRED EMBODIMENT

Figure 2:
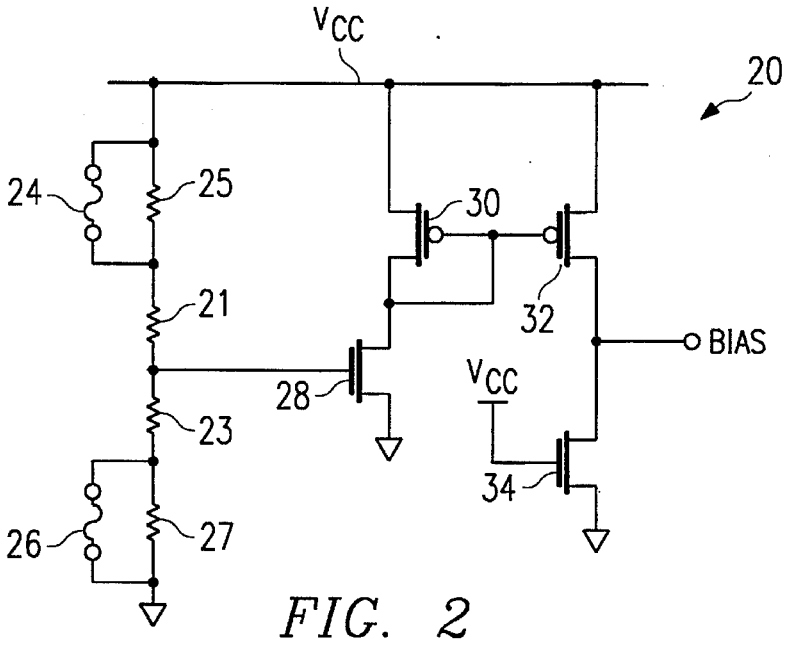
FIG. 2 is an electrical diagram, in schematic form, of a bias circuit according to the preferred embodiment of the invention.

Referring now to FIG. 2, the construction and operation of bias circuit 20 according to the preferred embodiment of the invention will now be described in detail. In general, bias circuit 20 is a current mirror bias circuit, in which the reference leg of the;mirror is responsive to a voltage divider. As will be evident from the description hereinbelow, bias circuit 20 is intended to provide a bias voltage on line BIAS to that varies in a consistent manner with variations in the value of power supply voltage $V_{cc}$, and in a way that is matched for certain manufacturing process parameters.

Figure 1:
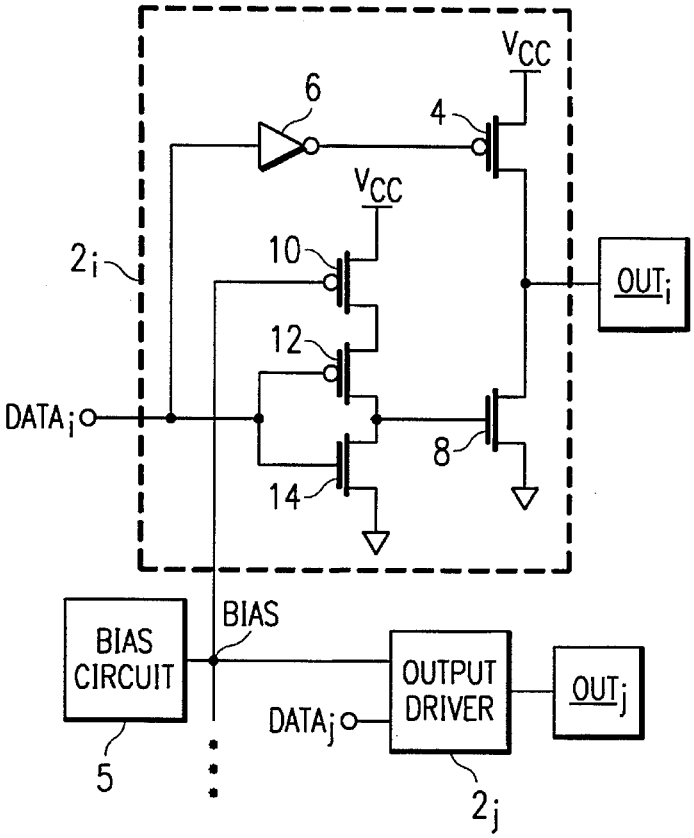
FIG. 1 (PRIOR ART)
FIG. 1 is an electrical diagram, in schematic and block form, illustrating a conventional output driver.

For example, bias circuit 20 may provide such a voltage on line BIAS to the gate of transistor 10 in drive circuits 2 of FIG. 1. In this case, it is preferable that the gate-to-source voltage of p-channel transistor 10 remain substantially constant over variations in $V_{cc}$, so that its current remains constant; in other words, so that the voltage at its gate on line BIAS follows variations in $V_{cc}$. This will ensure that the drive characteristics of drive circuits 2 to remain at an optimized speed versus noise operating point despite these variations, thus ensuring optimized operation of the integrated circuit over its specification range.

In this embodiment of the invention, bias circuit 20 includes a voltage divider of resistors 21, 23 connected in series between the $V_{cc}$ power supply and ground. The output of the voltage divider, at the node between resistors 21, 23, is presented to the gate of an n-channel transistor 28. Resistors 21, 23 are preferably implemented as polysilicon resistors, in the usual manner. As shown in FIG. 2, additional resistors 25, 27 may also be present in each leg of the voltage divider, with fuses 24, 26 connected in parallel therewith. In this way, the integrated circuit into which bias circuit 20 is implemented is fuse programmable to allow adjustment of the voltage applied to the gate of transistor 28, if desired. Indeed, it is contemplated that multiple ones of additional resistors 25, 27 and accompanying fuses may be implemented in the voltage divider, to allow a wide range of adjustment of the voltage output of the voltage divider.

As indicated above, the gate of transistor 28 receives the output of the voltage divider of resistors 21, 23. The source of transistor 28 is biased to ground, and the drain of transistor 28 is connected to the drain and gate of p-channel transistor 30, which in turn has its source tied to $V_{cc}$. The combination of transistors 28, 30 is a reference leg of a current mirror, with the current conducted therethrough substantially controlled by the voltage output of the voltage divider of resistors 21, 23. Accordingly, the voltage applied to the gate of transistor 28, and thus the current conducted by transistors 28, 30 in the reference leg of the current mirror, will vary with variations in the voltage of the $V_{cc}$ power supply, but will maintain the same ratio relative to the varying $V_{cc}$.

The output leg of the current mirror in bias circuit 20 includes p-channel mirror transistor 32 and linear load device 4. P-channel transistor 32 has its source connected to $V_{cc}$ and its gate connected to the gate and drain of transistor 30, in current mirror fashion. The drain of transistor 32 is connected to the linear load device 34, at line BIAS. Load device 34 may be implemented as an n-channel transistor 34, having its source at ground and its gate at $V_{cc}$, in which case the common drain node of transistors 32, 34 drives the bias voltage output on line BIAS. Alternatively, linear load device 34 may be implemented as a precision resistor, or as a two-terminal diode.

In any case, linear load device 34 is important in providing compensation for variations in process parameters, such as channel length. Variations in the channel length of transistors 30, 32 will cause variations in the current conducted by transistor 32 and thus, due to the linear nature of load device 34, will cause a corresponding variation in the voltage on line BIAS. Accordingly, bias circuit 20 provides an output voltage on line BIAS that tracks variations in process parameters affecting current conduction by transistors in the integrated circuit.

As noted above, the current conducted by transistor 32 is controlled to match, or to be a specified multiple of, the current conducted through transistor 30. Since the current conducted through transistors 28, 30 is controlled according to the divided-down voltage of the $V_{cc}$ power supply, the current conducted by transistor 32 (and thus the voltage on line BIAS) is therefore controlled by the $V_{cc}$ power supply. The voltage on line BIAS will thus also track modulation in the $V_{cc}$ power supply voltage, as will be described in further detail hereinbelow, by way of modulation in the voltage drop across linear load 34.

Certain sizing relationships among the transistors in bias circuit 20 are believed to be quite important in ensuring proper compensation. Firstly, transistor 28 is preferably near, but not at, the minimum channel length and channel width for the manufacturing process used. Use of near the minimum channel length is preferable, so that the current conducted by transistor 28 varies along with variations in the channel length for the highest performance transistors in the integrated circuit; use of a longer channel length would result in less sensitivity of transistor 28 to process variations. However, the channel length is somewhat larger than minimum so that hot electron effects and short channel effects are avoided. Transistor 28 also preferably has a relatively small, but not minimum, channel width, to minimize the current conducted therethrough, especially considering that bias circuit 20 will conduct DC current at all times through transistors 28, 30 (and mirror leg transistor 32 and linear load 34). An example of the size of transistor 28 according to a modern manufacturing process would be a channel length of 0.8 μm and a channel width of 4.0 μm, where the process minimums would be 0.6 μm and 1.0 μm, respectively.

P-channel transistors 30, 32 must also be properly sized in order to properly bias transistor 28 and linear load device 34 (when implemented as a transistor), respectively. For proper compensation of the bias voltage on line BIAS, transistor 28 is preferably biased in the saturation (square law) region, while transistor 34 is biased in the linear (or triode) region. This allows transistor 34 to act effectively as a linear resistive load device, while transistor 28 remains saturated. As is evident from the construction of bias circuit 20 in FIG. 2, such biasing depends upon the relative sizes of transistor 28 and 30, and the relative sizes of transistors 32 and 34.

It is preferable for transistor 30 to be as large as practicable so that the voltage at the gate of transistor 28 may be as near to $V_{cc}$ as possible while maintaining transistor 28 in saturation. This is because variations in $V_{cc}$ will be applied to the gate of transistor 28 in the ratio defined by the voltage divider of resistors 21, 23; accordingly, it is preferable that this ratio be as close to unity as possible, while still maintaining transistor 28 in saturation. A large W/L ratio for transistor 30 allows its drain-to-source voltage to be relatively small, thus pulling the drain voltage of transistor 28 higher, which allows the voltage at the gate of transistor 28 to be higher while still maintaining transistor 28 in saturation. The tracking ability of bias circuit 20 is thus improved by transistor 30 being quite large.

In the above example, where the $V_{cc}$ power supply voltage is nominally 5.0 volts, the following table indicates the preferred channel widths (in microns) of transistors 28, 30, 32 and 34 in the arrangement of FIG. 2, for the case where the channel length of each is 0.8 μm:

TABLE

| Transistor | Channel Width (μm) |
|---|---|
| 28 | 4.0 |
| 30 | 32.0 |
| 32 | 76.0 |
| 34 | 4.0 |

Figure 3:
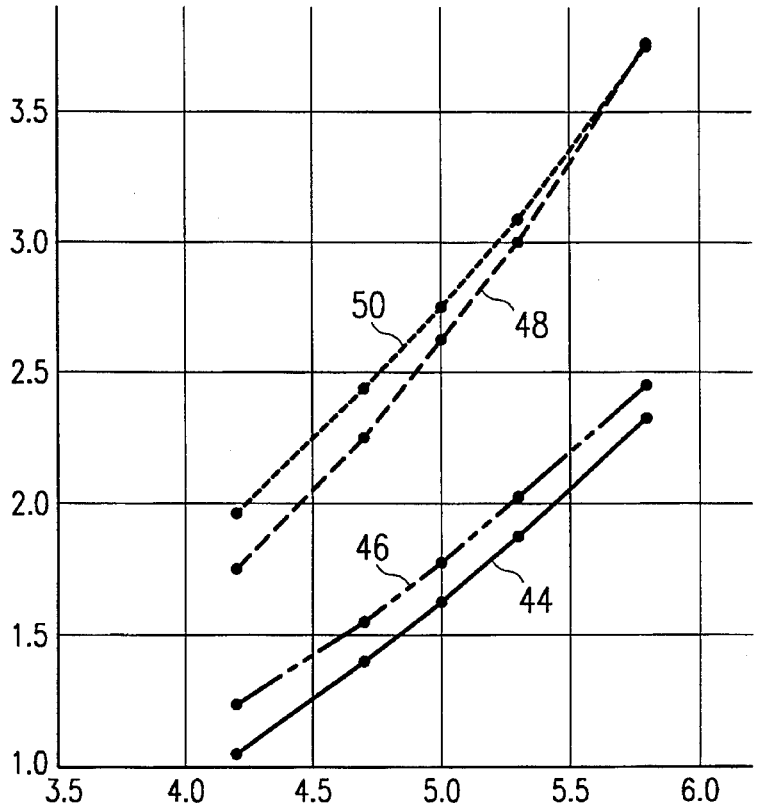
FIG. 3 is a plot of bias voltage versus $V_{cc}$ power supply voltage for various process conditions and temperatures, as generated by the circuit of FIG. 2.

It has been observed (through simulation) that this example of bias circuit 20 is effective in maintaining good tracking of the voltage on line BIAS over a relatively wide range of $V_{cc}$ supply voltage. FIG. 3 is a plot of the voltage on line BIAS as a function of $V_{cc}$, simulated for maximum and minimum transistor channel lengths in a 0.8 micron manufacturing process, illustrating the operation of bias circuit 20 according to the present invention. Curves 44, 46 in FIG. 3 correspond to the low-current process corner (i.e., maximum channel length) at 0° and 100° C. junction temperatures, respectively; curves 48, 50 in FIG. 3 correspond to the high-current process corner (i.e., minimum channel length) at 0° and 1000° C. junction temperatures, respectively. As is evident from FIG. 3, tracking of increasing $V_{cc}$ by the voltage on line BIAS is quite accurate, even over wide ranges in temperature and process parameters.

Figure 4:
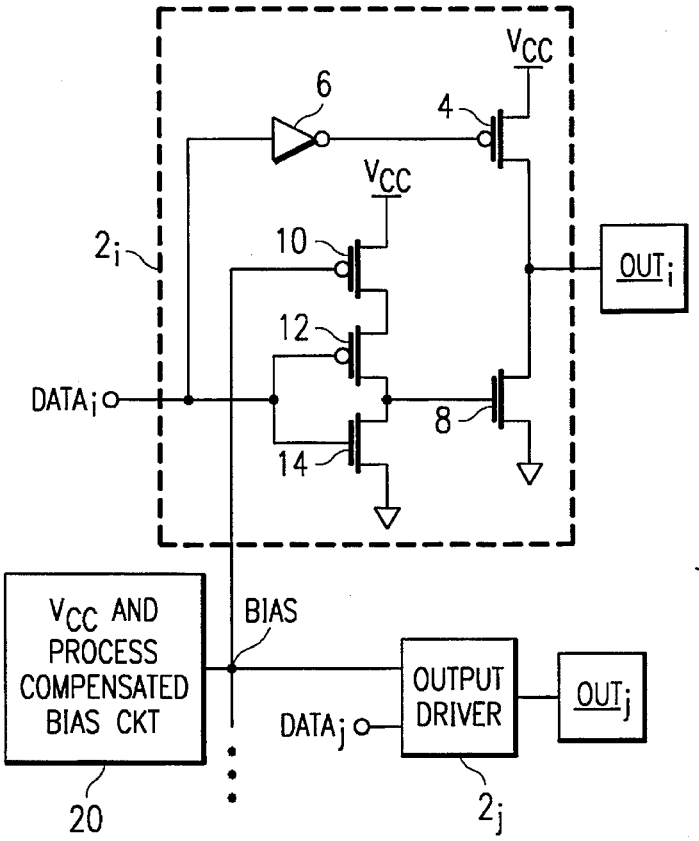
FIG. 4 is an electrical diagram, in block and schematic form, of an output driver incorporating the bias circuit of FIG. 2.

Referring now to FIG. 4, the incorporation of $V_{cc}$ and process compensated bias circuit 20 as described hereinabove, into a output driver circuit, is illustrated. The construction of the output driver circuit $2_i$ is similar to that described hereinabove relative to FIG. 1, with like elements referred to by the same reference numerals. However, bias circuit 20 according to the preferred embodiment of the invention as described hereinabove is used in place of conventional bias circuit 5. Accordingly, the voltage on line BIAS that is applied to the gate of transistor 10 will follow variations in the $V_{cc}$ power supply voltage (at the source of transistor 10). As a result, the current conducted through transistor 10 in drive circuit 2 will remain substantially constant, since its gate-to-source voltage remains constant.

Figure 5:
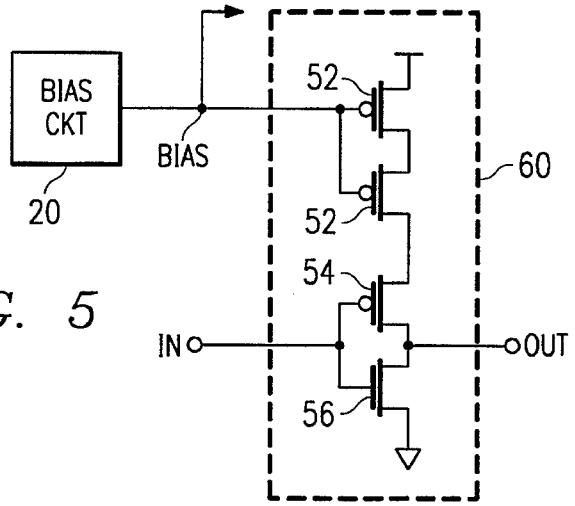
FIG. 5 is an electrical diagram, in schematic form, of the bias circuit used in the driver of FIG. 4 according to an alternative embodiment of the invention.

Referring now to FIG. 5, another application of bias circuit 20 according to the preferred embodiment of the invention will now be described in detail. Bias circuit 20 in FIG. 5 is constructed according to the preferred embodiment of the invention, as described hereinabove. In this example, line BIAS is applied to delay gate 60 to control the propagation delay between a signal on line IN and a corresponding signal on line OUT, for the case where the signal at line IN makes a high-to-low transition. In this example, delay gate 60 is constructed substantially as a CMOS inverter, with p-channel pull-up transistor 54 and n-channel pull-down transistor 56 having their drains connected together to drive line OUT, and having their gates connected together to line IN. The source of transistor 56 is connected to ground, as usual.

In this example, p-channel transistors 52 have their source/drain paths connected in series between $V_{cc}$ and the source of transistor 54. The gates of transistors 52 are connected together to line BIAS. As such, the current from $V_{cc}$ through transistor 54, which is used to pull up line OUT responsive to line IN making a high-to-low transition, is limited by the conduction of transistors 52, under control of the voltage on line BIAS from bias circuit 20. Accordingly, the propagation delay through delay gate 60 is controlled by the voltage on line BIAS. While two transistors 52 are illustrated in FIG. 5, it is of course contemplated that a single transistor 52, or more than two transistors 52, may alternatively be used, depending upon the desired delay characteristics.

As described above, the voltage on line BIAS tracks variations in power supply voltage and in process parameters. Accordingly, the gate-to-source voltage of transistors 52 in delay gate 60 according to this embodiment of the invention will be maintained relatively constant over variations in $V_{cc}$, and over variations in process parameter, which in turn will maintain the propagation delay through delay gate 60 relatively constant over such variations. As a result, delay gate 60 according to this embodiment of the invention enables the integrated circuit designer to more aggressively design certain internal clock timing, with the knowledge that the propagation delay will remain relatively constant over variations in power supply voltage and process parameters. Less guardbanding between low and high current process corners, and low and high power supply voltages, is therefore required.

Figure 6:
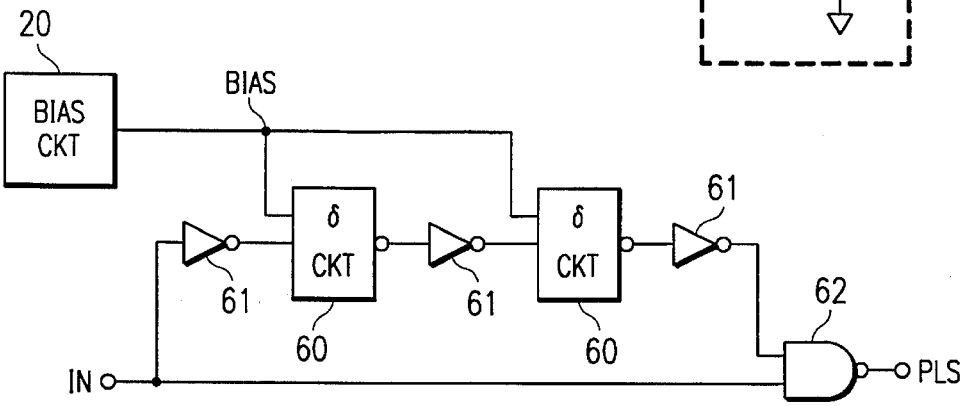
FIG. 6 is an electrical diagram, in schematic form, of a delay element using a bias voltage generated according to the preferred embodiment of the invention.

Referring now to FIG. 6, another use of bias circuit 20 according to the preferred embodiment of the invention will now be described in detail, namely the use of bias circuit 20 in a pulse generating circuit. FIG. 6 illustrates a pulse generating circuit for generating a pulse at line PLS responsive to a transition of a logic signal at line IN. In summary, NAND function 62 presents a low logic level on line PLS responsive to the logic level at its two inputs both being at a high logic level, and presents a low logic level otherwise. Line IN is connected directly to a first input of NAND function 62, and is connected to a second input of NAND function 62 through an odd-numbered series of delaying inverting functions 60, 61 (in this case five such functions, it being understood that any number of such functions may be used). As such, in the steady state, the two inputs to NAND function 62 will be logical complements of one another (due to the odd number of inverting elements 60, 61); however, for a delay period following a transition of the signal at line IN (such delay period defined by the propagation delay of the series of functions 60, 61), the two inputs to NAND function 62 will be identical. Accordingly, in this embodiment of the invention, a positive logic pulse will be generated on line PLS for a period of time following a low-to-high transition at line IN, with the period of time determined by the propagation delay of the series of functions 60, 61.

Delay gates 60 are constructed as described above relative to FIG. 5, and thus provide a relatively constant propagation delay, controlled by line BIAS from bias circuit 20 constructed as described hereinabove, in the inverting of a high-to-low logic transition received at its input. In the circuit of FIG. 6, it is therefore preferable that the overall delay of the circuit (and thus the pulse width at line PLS) be determined primarily by delay gates 60, so that the pulse width at line PLS be compensated for variations in power supply voltage and process parameters. Accordingly, in this example of the invention, since the pulse at line PLS is generated by NAND function 62 responsive to a low-to-high transition at line IN, delay gates 60 are positioned second and fourth in the series of five inverting functions, with conventional inverters 61 positioned first, third and fifth. In this way, a low-to-high transition at line IN is presented to the input of delay gates 60 as high-to-low transitions, after one or three inversions.

The circuit of FIG. 6 is thus able to produce a pulse of a width determined by delay gates 60, and that remains relatively constant over variations in power supply voltage and process parameters. The circuit designer may thus use the circuit of FIG. 6 to produce pulses that are designed aggressively for the worst case voltage and process conditions for the integrated circuit, while remaining confident that the pulse width will not be excessively small at the highest speed voltage and process conditions.

Figure 7:
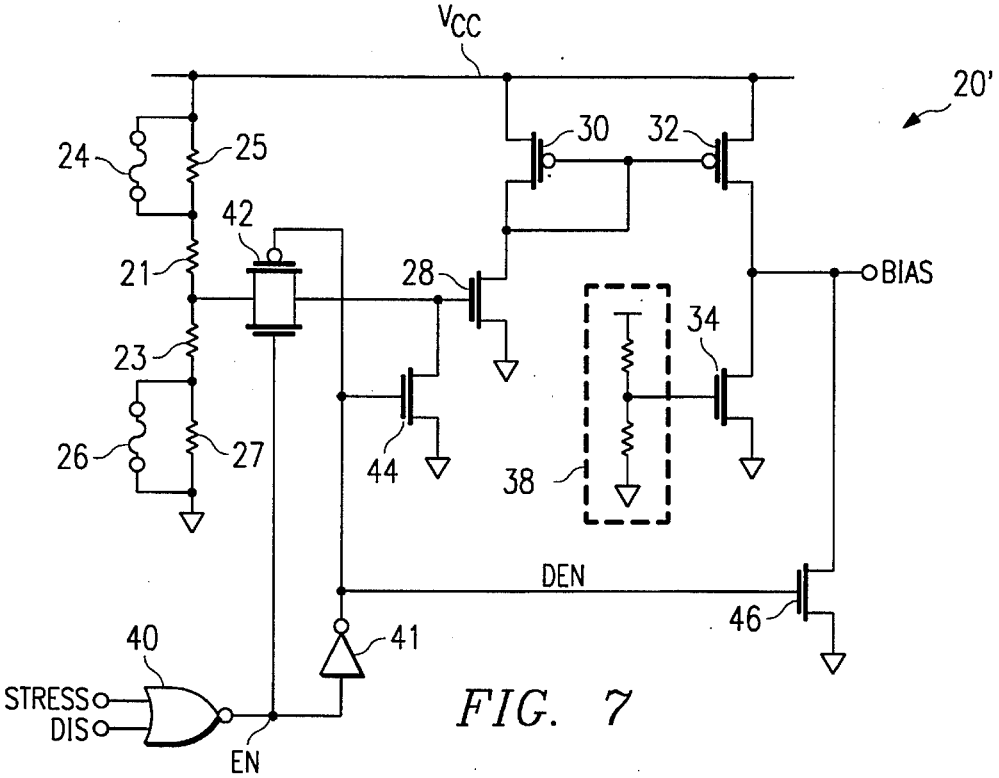
FIG. 7 is an electrical diagram, in schematic form, of a pulse generating circuit using a bias voltage generated according to the preferred embodiment of the invention.

Referring now to FIG. 7, bias circuit 20' according to an alternative embodiment of the invention will now be described in detail. Similar elements in circuit 20' as those in circuit 20 described hereinabove will be referred to with the same reference numerals.

Bias circuit 20' is constructed similarly as bias circuit 20 described hereinabove. In this example, however, the gate of linear load transistor 34 is set by voltage divider 38, such that the gate voltage is a specified fraction of the $V_{cc}$ power supply voltage. Transistor 34, while operating substantially as a linear load, is in fact a voltage-controlled resistor, such that its on resistance is a function of the gate-to-source voltage. By applying only a fraction of $V_{cc}$ to the gate of transistor 34, as shown in FIG. 7, undesired reduction of the resistance of transistor 34 may be reduced in the event that $V_{cc}$ makes a positive transition.

Bias circuit 20' according to this alternative embodiment of the invention also includes circuitry for disabling the slew rate control function when desired. When the bias function is disabled, transistors 10 of drive circuits 2 are fully turned on, with a low logic level on line BIAS in this example. As shown in FIG. 7, NOR function 40 receives inputs on lines DIS and STRESS, for example. Line DIS is generated elsewhere on the integrated circuit, and presents a high logic level when bias circuit 20' is to be disabled; it is contemplated that line DIS may be dynamically generated so as to be present for particular operations, or alternatively line DIS may be driven by a fuse circuit so that bias circuit 20' is forced to the disabled state by the opening of a fuse in the manufacturing process. Line STRESS presents a high logic level during a special test mode, such as when extraordinarily high voltages are presented to certain nodes in the integrated circuit. Line STRESS is thus generated by a special test mode control circuit, for example responsive to an overvoltage condition, as is well known in the art.

The output of NOR gate 40 thus presents a high logic level signal, on line EN, responsive to neither of lines DIS and STRESS at its inputs being asserted, to enable bias circuit 20'; NOR gate 40 conversely presents a low logic level on line EN responsive to either of the disabling conditions indicated on lines DIS and STRESS. Line EN is directly connected to the n-channel side of pass gate 42, and is connected via inverter 41 to the p-channel side of pass gate 42, so that pass gate 42 is conductive when line EN is high, and open when line EN is low (i.e., when line DEN, at the output of inverter 41, is high). Line DEN is also connected to the gates of n-channel transistors 44 and 46. Transistor 44 has its drain connected to the gate of transistor 28, and transistor has its drain connected to line BIAS; the sources of transistors 44, 46 are connected to ground.

In operation, when line EN is high due to both lines DIS and STRESS being low, pass gate 42 is conductive and transistors 44 and 46 are turned off. The operation of bias circuit 20' in this condition is identical to that of bias circuit 20 described hereinabove, such that line BIAS tracks changes in the $V_{cc}$ power supply voltage so as to control transistor 10 in drive circuits 2 in a manner to maintain operation at or near the optimized condition, as described hereinabove. When line EN is low and line DEN is high, due to either of lines DIS and STRESS being asserted to a high level, pass gate 42 is turned off. Transistor 44 is turned on by line DEN being high, which turns off transistor 28 by pulling its gate to ground; this inhibits current from being conducted through either of transistors 30, 32. Transistor 46 is also turned on by line DEN being high, pulling line BIAS to ground. Referring back to FIG. 1, p-channel transistor 10 is fully turned on by line BIAS being at ground, in which case the slew rate of drive circuits 2 is not controlled. Bias circuit 20' according to this alternative embodiment thus allows for the slew rate control function to be disabled for drive circuits 2.

The present invention, according to either of the above-described embodiments, thus provides the important benefit of allowing for optimization of various timing pulses within an integrated circuit. As noted above, this optimization may be applied to control of the slew rate, or switching rate, of output drivers in an integrated circuit, and may be applied to optimizing delay gates and pulse generation circuits. This optimization is maintained over variations in the power supply voltage and over variations in important process parameters such as channel length, according to the present invention.

While the invention has been described herein relative to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

We claim:

1. A circuit for producing a compensated bias voltage in an integrated circuit, comprising:

a resistor divider coupled between a power supply voltage and a reference voltage, for producing a divided voltage;

a current mirror, having a reference leg and an output leg, wherein the current through the reference leg is controlled by the divided voltage, and wherein the output leg comprises:

a mirror transistor, for conducting a mirrored current corresponding to the current through the reference leg; and a load for conducting the mirrored current and for producing a bias voltage at a bias output node responsive to the mirrored current; and a pass gate, coupled between the voltage divider and the current mirror, for disconnecting the voltage divider from the current mirror responsive to a disable signal.

2. An output driver circuit for driving an output node to a logic function responsive to a data signal received at a data node, comprising:

a first drive transistor, having a conduction path connected between the output node and a first power supply voltage, and having a control terminal;

a slew rate control circuit, having an input coupled to the data node and an output coupled to the control terminal of the first drive transistor, comprising:

a current limiting transistor, having a conduction path and a control electrode;

a first transistor, having a conduction path connected in series with the conduction path of the current limiting transistor between the control terminal of the first drive transistor and, a first voltage, and having a control terminal coupled to the data node, wherein the first voltage will turn on the first drive transistor if applied to the control terminal of the first drive transistor;

a second transistor, having a conduction path connected on one side to the control terminal of the first drive transistor, and on another side to a second voltage, and having a control terminal coupled to the data node; and a bias circuit for applying a bias voltage to the control terminal of the current limiting transistor that follows variations in the first voltage, comprising:

a resistor divider coupled between the first voltage and a reference voltage, for producing a divided voltage; and a current mirror, having a reference leg and an output leg, wherein the current through the reference leg is controlled by the divided voltage, and wherein the output leg comprises:

a mirror transistor, for conducting a mirrored current corresponding to the current through the reference leg; and a load, for conducting the mirrored current and for producing the bias voltage at a bias output node responsive to the mirrored current; and a disable transistor, having a control electrode receiving a disable signal, for biasing the current limiting transistor to an on state responsive to receiving the disable signal.

3. A circuit for producing a compensated bias voltage in an integrated circuit, comprising:

a resistor divider coupled between a power supply voltage and a reference voltage, for producing a divided voltage;

a current mirror, having a reference leg and an output leg, wherein the reference leg comprises:

a reference field effect transistor having a drain connected to a mirror node, having a source connected to the power supply voltage, and having a gate connected to its drain;

A modulating field effect transistor biased in the saturation region, having a conductive path connected between the mirror node and the reference voltage, and having a gate receiving the divided voltage; and wherein the output leg comprises:

a mirror transistor, for conducting a mirrored current corresponding to the current through the reference leg; and a linear load, for conducting the mirrored current and for producing a bias voltage at a bias output node responsive to the mirrored current; and a pass gate, coupled between the voltage divider and the current mirror, for disconnecting the voltage divider from the current mirror responsive to a disable signal.

4. An output driver circuit for driving an output node to a logic function responsive to a data signal received at a data node, comprising:

a first drive transistor, having a conduction path connected between the output node and a first power supply voltage, and having a control terminal;

a slew rate control circuit, having an input coupled to the data node and an output coupled to the control terminal of the first drive transistor comprising:

a current limiting transistor, having a conduction path and a control electrode;

a first transistor, having a conduction path connected in series with the conduction path of the current limiting transistor between the control terminal of the first drive transistor and a first voltage, and having a control terminal coupled to the data node, wherein the first voltage will turn on the first drive transistor if applied to the control terminal of the first transistor;

a second transistor, having a conduction path connected on one side to the control terminal of the first drive transistor, and on anther side to a second voltage, and having a control terminal coupled to the data node; and a bias circuit, for applying a bias voltage to the control terminal of the current limiting transistor that follows variations in the first voltage comprising:

a resistor divider coupled between the first voltage and a reference voltage, for producing a divided voltage;

a current mirror, having a reference leg and an output leg, wherein the reference leg comprises:

a reference field effect transistor having a drain connected to a mirror node, having a source connected to the power supply voltage, and having a gate connected to its drain;

A modulating field effect transistor biased in the saturation region, having a conductive path connected between the mirror node and the reference voltage, and having a gate receiving the divided Voltage; and wherein the output leg comprises:

a mirror transistor, for conducting a mirrored current corresponding to the current through the reference leg; and a linear load, for conducting the mirrored current and for producing the bias voltage at a bias output node responsive to the mirrored current; and a disable transistor, having a control electrode receiving a disable signal, for biasing the current limiting transistor to an on state responsive to receiving the disable signal.

* * * * *